US005441189A

United States Patent [19]

Formon et al.

[11] Patent Number: 5,441,189

[45] Date of Patent: Aug. 15, 1995

[54] METHOD AND APPARATUS FOR DISPENSING FLEXIBLE SHEET MATERIAL

[75] Inventors: John S. Formon, Marietta, Ga.; Paul W. Jespersen, Salt Lake City, Utah

[73] Assignee: Georgia-Pacific Corporation, Atlanta, Ga.

[21] Appl. No.: 91,409

[22] Filed: Jul. 14, 1993

Related U.S. Application Data

[63] Continuation of Ser. No. 935,342, Aug. 28, 1992, abandoned, which is a continuation of Ser. No. 660,892, Feb. 26, 1991, abandoned.

[51] Int. Cl.[6] ..... B26F 3/02; A47K 10/36

[52] U.S. Cl. ..... 225/2; 225/15; 225/96; 225/106; 83/334; 83/337; 83/660

[58] Field of Search ..... 225/2, 4, 15, 96, 106, 225/103; 83/334, 335, 337, 339, 660

[56] References Cited

U.S. PATENT DOCUMENTS

| | | | |
|---|---|---|---|
| Re. 28,911 | 7/1976 | Jespersen et al. | 83/334 |
| 454,317 | 6/1891 | Wheeler . | |
| 764,806 | 7/1904 | Ham . | |
| 1,543,299 | 6/1925 | Shelley . | |
| 1,811,537 | 6/1931 | Cummings . | |
| 1,975,414 | 10/1934 | Wade | 242/55.5 |
| 2,224,572 | 12/1940 | Harvey | 271/2.3 |
| 2,886,226 | 5/1959 | Batlas et al. | 225/106 |
| 3,024,669 | 3/1962 | Creed et al. | 74/821 |
| 3,575,328 | 4/1971 | Jespersen | 225/2 |
| 3,739,965 | 6/1973 | Jespersen et al. | 225/96 |
| 3,851,810 | 12/1974 | Jespersen | 226/121 |
| 3,896,691 | 7/1975 | Granger et al. | 83/335 |
| 3,998,120 | 12/1976 | Granger et al. | 83/335 |
| 4,122,738 | 10/1978 | Granger | 83/314 |
| 4,142,431 | 3/1979 | Jespersen | 83/335 |
| 4,176,569 | 12/1979 | DeLuca | 83/337 |
| 4,188,844 | 2/1980 | DeLuca | 83/335 |
| 4,206,858 | 6/1980 | DeLuca et al. | 225/96 |
| 4,213,363 | 7/1980 | Granger | 83/314 |
| 4,286,489 | 9/1981 | DeLuca | 83/335 |
| 4,404,880 | 9/1983 | DeLuca | 83/42 |
| 4,621,755 | 11/1986 | Granger | 83/334 |
| 4,635,837 | 1/1987 | Granger | 225/96 |
| 4,712,461 | 12/1987 | Rasmussen | 83/334 |
| 4,732,306 | 3/1988 | Jesperson | 225/2 |
| 5,013,291 | 5/1991 | Granger | 493/357 |
| 5,147,279 | 9/1992 | Granger | 493/448 |

*Primary Examiner*—Eugenia Jones

*Attorney, Agent, or Firm*—Banner & Allegretti, Ltd.

[57] ABSTRACT

A dispenser for cutting and feeding a web of flexible sheet material is described in which a feed roller carries a web cutting blade and a spring connected to an eccentric crank affixed to the feed roll. While initial movement of the web through the mechanism and actuation of the cutter to effect partial separation of the web material is produced by the user's pull on the web, such pull also loads the spring which, upon unloading, delivers the cut web material from the dispenser. The spring is designed to gradually arrest rotation of the feed roll and to be exhausted of stored energy at a predetermined position of the feed roll whereupon the uncut segments of web material are efficaciously severed and the leading end of the succeeding web material is automatically positioned where it can be readily grasped by a subsequent user.

21 Claims, 7 Drawing Sheets

METHOD AND APPARATUS FOR DISPENSING FLEXIBLE SHEET MATERIAL

This application is a continuation of application Ser. No. 07/935,342, filed Aug. 28, 1992, now abandoned, which is a continuation of application Ser. No. 07/660,892, filed Feb. 26, 1991 now abandoned.

BACKGROUND OF THE INVENTION

The present invention relates to flexible sheet material dispensers, such as dispensers for paper towels. The invention particularly relates to a method for cutting and dispensing individual sheets of creped paper toweling and to apparatus for practicing such method.

Dispensers for continuous, unperforated flexible sheet material, such as paper toweling, are well known. Such dispensers include those in which the sheets are simply torn from the web by the user or, more commonly, those in which the sheets are completely severed by a cutter in the dispenser for removal by a user. Also included are dispensers in which the cutter in the dispenser produces a line of cut containing residual segments of uncut material in the web defining the desired sheet that is, thereafter, completely severed by the user upon removal. The first-mentioned type of dispenser has the disadvantage that it employs no control against the length of web material dispensed prior to severance such that a user can wastefully pull out an excessive length of material prior to tearing it off. Such dispensers have the further disadvantage that, following removal of the sheet by the user, the next user must pay out a succeeding length of web by pulling a handle, turning a crank, or activating some other device that requires touching or handling the mechanism which, in the environment that such dispensers are located, i.e., wash rooms and the like, is undesirable.

Accordingly, in dispensers of more recent design these disadvantages have been overcome by the utilization of cutting devices in the dispenser that cut the web material to sheet length as the user pulls it from the dispenser. Such apparatus typically involve a feed roll from which paper is supplied by a user grasping the free end of the web that is disposed outside the dispenser chassis and pulling it to operate the feed roll. In these devices a stored energy mechanism, such as a spring, may be associated with the feed roll to acrid/ate the cutter and/or to conduct the web material from the dispenser. As mentioned, cutters for such dispensers may cut the material to totally sever a sheet from the web or, alternatively, may produce such a cut as will only partially sever the web, leaving the sheet connected to the web by means of one or more unsevered segments of residual web material, for removal by the user following conduct of the sheet from the dispenser by the feed roll.

Dispensers of the concerned type in which a cutter operates in conjunction with a feed roll and in which the motive force for the operation of the dispenser is provided by the web material being pulled by the user are exemplified by U.S. Pat. Nos. 3,575,328, 4,122,738 and 4,621,755. These dispensers each characteristically employ an over-center spring drive that is loaded during a first portion of the operating cycle of the mechanism during which cutting is normally effected as the web material, in friction contact with the feed roll, is pulled from the dispenser. After completion of the cutting operation, when the feed roll is rotated beyond the over-center condition, the spring is unloaded and the energy stored therein is utilized to drive the feed roll to conduct the cut web portion from the dispenser and to dispose the leading end of the succeeding length of web material at a location outside the dispenser chassis where it can be readily grasped by the next user.

In each of U.S. Pat. Nos. 3,575,328, 4,122,738 and 4,621,755, which typify the concerned devices, the length of web material removed from the dispenser is controlled by means of a positive or hard stop mechanism that limits the amount of rotation permitted the feed roll to one revolution and, concomitantly, the length of web material removed corresponding substantially to the developed circumference of the exterior surface of the feed roll. In the mechanism described in U.S. Pat. No. 3,575,328 in which the cutting knife produces a perforated, or only partially severed, line of cut, the stop mechanism serves the additional function of providing an abrupt arresting force on the web material whereupon the sheet defined by the perforated line of cut is caused to be completely severed by the pulling force imparted by the user.

It has been determined that positive stop mechanisms manifest significant undesirable characteristics. The more obvious of these undesirable characteristics are the additional cost that they add to a dispenser, both in terms of purchase price and in terms of the additional space required to accommodate them. Also, since these mechanisms are subject to repeated impact stresses, they are prone to frequent malfunction and breakage.

Furthermore, such positive stop mechanisms are particularly disadvantageous when employed with apparatus intended to dispense partially severed soft, relatively weak flexible sheet material. Under these conditions, the web material may become separated by tearing along the line of cut before the stop mechanism is activated, whereupon the next user can only remove an unusable limited amount of material before the stop is activated thereby preventing the removal of any more material.

Obviously, such problems can be overcome by increasing the strength of the unsevered segments of web material that hold the web together along the line of cut; however, when this is done, particularly when the material is highly absorbent and the user's hands are wet, the material cannot be relied upon to sever along the line of cut when the stop mechanism is activated. Instead, the pulling action of the user frequently results in severance of only the wet part of the web material held in the user's hands, which, more often than not, becomes untidy debris deposited on the floor beneath the dispenser.

It is to the amelioration of the above described problems, therefore, to which the present invention is directed.

SUMMARY OF THE INVENTION

Accordingly, a principal object of the present invention is to provide an improved dispenser for flexible sheet material and a method for operating the same.

Another object of the present invention is to provide improved apparatus and method for dispensing sheets obtained from an elongated web of flexible material by the operation of a cutter and dispensed by withdrawal therefrom by the user.

Yet another object of the present invention is to provide improved apparatus and method for dispensing partially severed sheets of predetermined length from an elongated web of material in which, in withdrawing the material from the dispenser, the user effects complete severance of the sheet from the web and automatically delivers the free end of the succeeding material to a position for grasping by the next user.

Still another object of the present invention is to provide an improved dispenser for soft, absorbent paper toweling capable of producing the desired results without need for the user to touch anything but the toweling being dispensed.

Directed to achieving the desired results is a dispenser for flexible sheet material comprising a chassis forming a housing having a material discharge opening, means carried by the chassis for feeding a supply of flexible sheet material, means for cutting the web to produce therein a transverse line of cut containing residual unsevered segments of web material for maintaining the continuity of the web, a feed roll mounted on the chassis for rotation through an operating cycle in which the web is conducted from the feed means into operative relation to the cutting means, and thence to a predetermined position outside the discharge opening to be grasped by a user for pulling the web from the dispenser to thereby impart rotational movement to the feed roll, and energy storing means operatively connected to the feed roll to be loaded during rotation of the feed roll through one portion of the operating cycle and unloaded during another portion of the operating cycle for moving the feed roll to conduct the sheet material web, with the line of cut thereon, exteriorly of the discharge opening, the energy storing means imparting a resistive force to the feed roll effective to operate against the pull of the user to impart a gradually increasing force on the web for severing the residual segments.

Also involved is a method for dispensing a web of flexible sheet material from a dispenser having a discharge opening and a feed roll traversed by the web, cutting means operable as the web traverses the feed roll and energy storing means operatively connecting the feed roll, comprising the steps of pulling the web to impart rotation of the feed roll and to load the spring over one portion of the rotational cycle of the feed roll, activating the cutting means for partially severing the web, driving the feed roll by the energy stored in the spring over another portion of the rotational cycle of the feed roll to deliver the partially severed web to a predetermined position beyond the dispenser discharge opening, and thereafter severing the web by imparting a gradually increasing tensile strain on the unsevered portion of the web against the resistance produced by loading the spring.

These and other aspects of the invention and their advantages will become more apparent by reference to the following detailed description of the invention in conjunction with the appended drawings.

DETAILED DESCRIPTION OF THE PREFERRED EMBODIMENT

Figure 1:
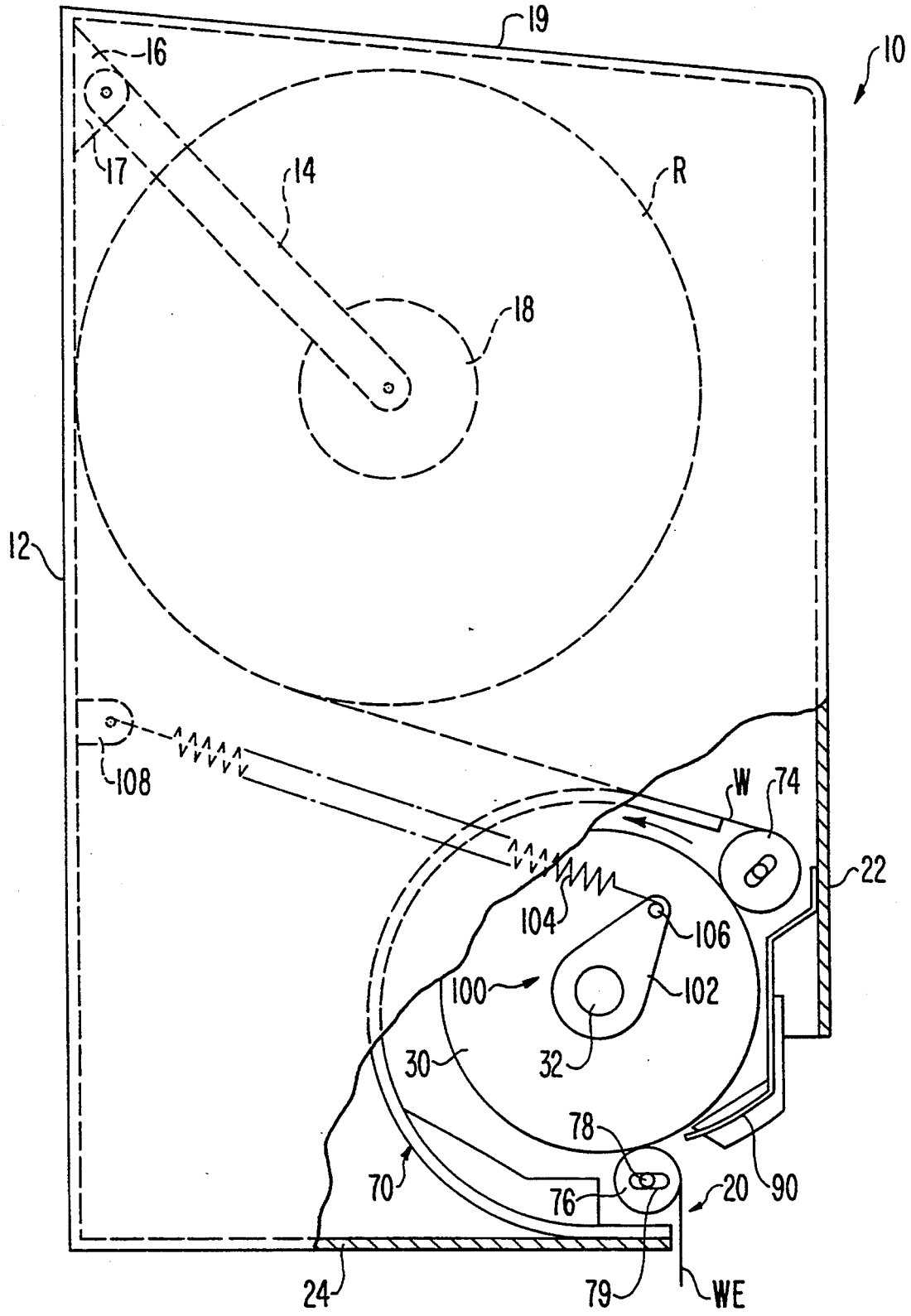
FIG. 1 is a somewhat diagrammatic side elevational view, with portions thereof in section, of a web material dispenser according to the present invention.

FIG. 1 diagrammatically illustrates a dispenser organization 10 for practicing the invention. The dispenser 10 comprises a cabinet chassis including a back plate 12 provided with means (not shown) to permit attachment to an upstanding wall, or the like. A yoke 16, pivotally attached to the plate 12, as by means of brackets 17, mounts a supply roll R of flexible sheet web material, such as paper toweling. Each leg of the yoke 14 carries at its free end a cup 18 adapted to be inserted into an end of the core of the supply roll R, such that the roll can readily rotate when resting against the back plate 12. Such mounting for a supply roll in a dispenser chassis is conventional.

The chassis of the dispenser 10 is enclosed by a cover 22 that may be suitably connected, as by means of pivot connections (not shown), to the back plate 12. Such form of connection enables the cover to be readily opened to permit access to the interior, as for example, for replacing spent supply rolls R. A discharge opening 20 is disposed at the bottom of the front wall of the cabinet cover 22 from whence a web W of flexible sheet material withdrawn from the roll R is suitably dispensed from the apparatus, as hereinafter described.

Figure 2:
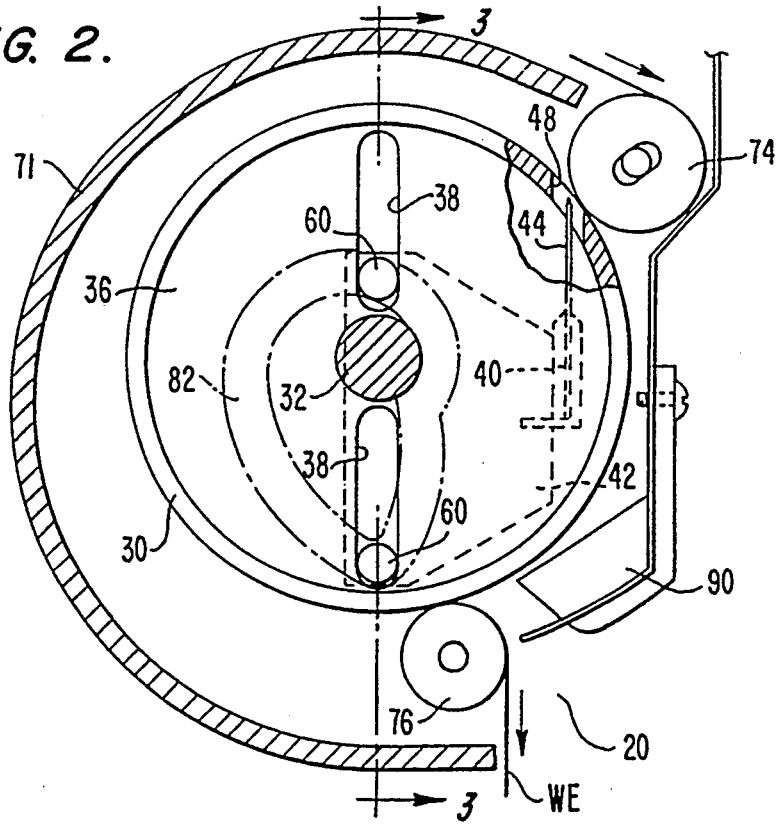
FIG. 2 is an enlarged sectional view of the feed roller and cutter apparatus of the dispenser of FIG. 1.
Figure 3:
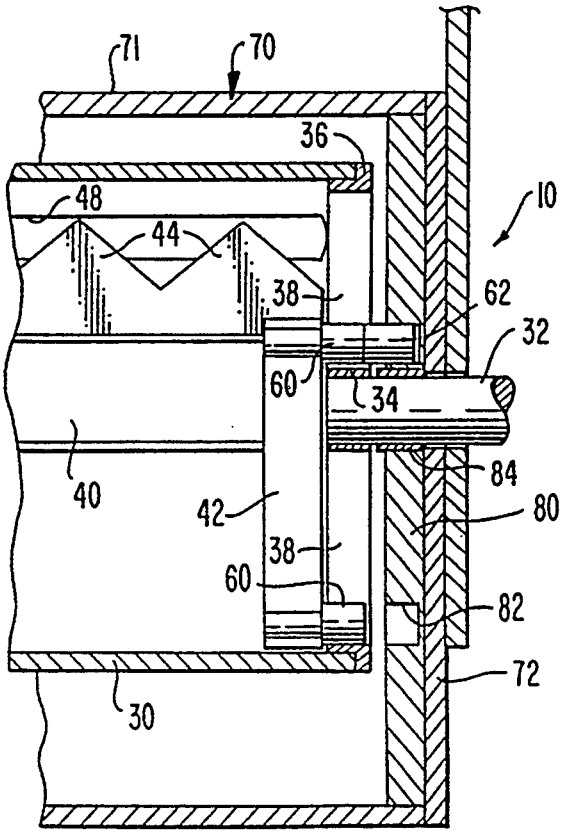
FIG. 3 is a sectional view taken along line 3—3 of FIG. 2.

Referring to FIGS. 1 to 4, a feed roll 30 according to the invention is rotatably mounted on stub shafts 32 extending axially outwardly from the opposite ends thereof. Each stub shaft 32 has one end fixedly securing a central bore 34 in a hub 36 of feed roll 30, as best shown in FIG. 3. The outer end of one of the stub shafts 32 may be provided with a hand wheel (not shown) fixedly secured thereto to enable manual rotation of the feed roll 30 when desired as, for example, for initially threading the web W of flexible sheet material from supply roll R through the dispensing and cutting mechanism to the discharge opening 20. Each of the feed roll hubs 36 is formed, as shown, with a pair of diametrically aligned slots 38. These pairs of slots in the hubs 36 at the opposite ends of the feed roll 30 form part of the mounting means for the cutter mechanism, as hereinafter described.

Figure 5:
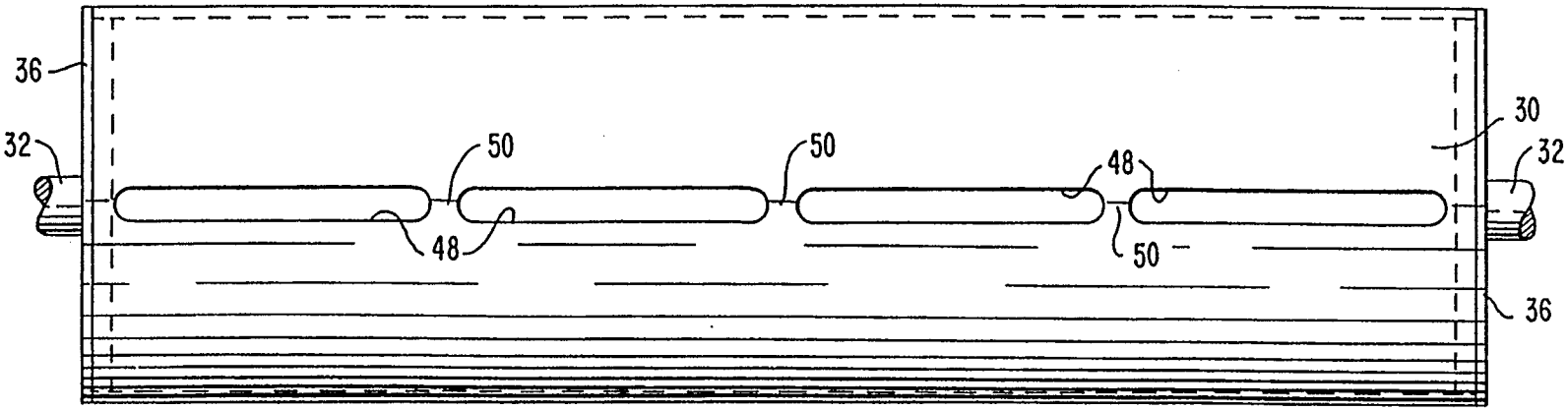
FIG. 5 is a plan view of the feed roll shown in FIG. 1.
Figure 6:
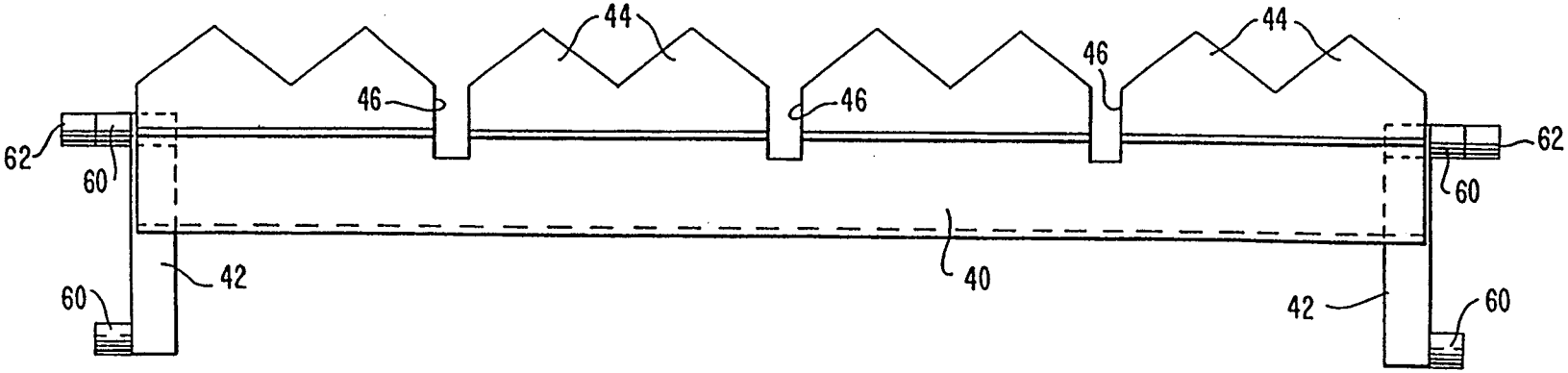
FIG. 6 is an elevational view of the cutting blade utilized in the practice of the invention.

The cutter mechanism comprises a carrier structure for a cutting blade 40 including a pair of oppositely spaced plates 42 (FIG. 3). The plates 42 are each fixedly mounted on each end of the cutting blade 40 and extend perpendicularly to the length of the blade. As best shown in FIG. 6, the blade 40 is formed with a plurality of teeth 44 longitudinally spaced along the length thereof. In the illustrated embodiment, four pairs of teeth 44 are provided along the length of blade 40 with each pair being separated from the next by a recess 46. The feed roll 30, on its external surface, is provided with a plurality of apertures defined by longitudinally aligned slots 48. Four such slots are shown in FIG. 5 with these slots being separated by continuous surface portions 50 which are part of the external surface of the feed roll 30.

The cutting blade 40 is disposed within feed roll 30, with the respective pairs of teeth 44 on the blade 40 adapted to project outwardly through the slots 48, and the solid portions 50 of the feed roll periphery being received by the three recesses 46. By means of this cutting blade design, the cut produced in the web of flexible sheet material as it passes over the surface of feed roll 30 is along a substantially straight line extending parallel to the axis of feed roll 30. The line of cut produced by the illustrated blade 40 contains three small uncut residual portions in the web which correspond essentially to the width of recesses 46 in the blade and length of solid portions 50 on the surface of the feed roll. By means of these small uncut portions spaced transversely across the web W, the continuity of the web is maintained, notwithstanding that it contains a substantial line of cut, while it traverses the mechanism within the dispenser chassis 10 before reaching the discharge opening 20. As is described in greater detail later, once that portion of the web containing the line of cut is conducted by the feed roll 30 through the opening 20 and thereafter subjected to a pulling force, the sheet defined by the line of cut is easily separated by the breaking of the uncut web portions produced by the configuration of the cutting blade 40 and the cooperating slots 48 in the feed roll surface. The user thereby effectively obtains the appropriate length of toweling.

Each of the carrier plates 42 attaching the opposite ends of cutting blade 40 has a pair of guide pins 60 extending normally to the plane of the plate. These pins 60 are positioned on the respective plates 42 to be guidingly received in the aligned slots 38 formed in each hub 36 at the ends of feed roller 30. By means of this mounting arrangement the cutting blade 40 reciprocates in a path which is parallel to, and laterally offset from, a radius of the feed roll 30. This radius corresponds to the axis of the aligned slots 38 which extend along a diameter of feed roll 30. Thus, not only does the mounting means enable movement of the cutting blade 40 in a path parallel to, and laterally offset from, this radius of feed roll 30, but it also provides for reciprocation of the guide pins 60 along this same feed roll radius.

As shown in FIG. 6, one of the guide pins 60 on each of the carrier plates 42 has a cam follower 62 formed as an extension thereof. These cam followers 62, disposed at opposite ends of the feed roll 30, extend outwardly beyond the ends of feed roll 30, as best shown in FIG. 3. Thus, with the guide pins 60 on each carrier plate 42 received in the pairs of aligned slots 38 in the hub 36 at each end of the feed roll, the cam followers 62 extend oppositely outwardly beyond the feed roll ends to engage a stationary cam 82 mounted on the dispenser chassis, as described hereinafter.

Within the lower forward portion of dispenser chassis 10 immediately adjacent the discharge opening 20, a mounting structure 70 supports the feed roll 30 and other components that comprise the dispensing and cutting mechanism. The disposition of the casing 70 within the dispenser chassis 10 is schematically represented in FIG. 1; however, the components of the casing 70 may generally be seen in the sectional view of FIG. 3. The casing 70 includes a housing 71 formed as a portion of a cylinder having an internal diameter somewhat larger than the diameter of feed roll 30. Housing 71 extends continuously from the location at which the web W of flexible sheet material enters the dispensing and cutting mechanism and terminates adjacent the discharge opening 20. The housing 71 extends transversely across the dispenser chassis 10 having its ends closely spaced from the sides of the pivotally mounted cover 19. Housing 71 may have its ends closed by end plates 72 which are appropriately secured thereto, as shown in section in FIG. 3.

Within the enclosure defined by the housing 71 and the end plates 72 is a lead-in pinch roll 74, which is preferably mounted on a rotatable shaft and is biased by spring means (not shown) against the peripheral surface of feed roll 30. An exit pinch roll 76 is disposed immediately adjacent the dispenser exit 20 and is also biased against the peripheral surface of feed roll 30. In the preferred embodiment of the invention the exit pinch roll 76 contains at each end a stub shaft 78, or the like, for rotatable mounting in an elongated journal opening, indicated in FIG. 1 by the dotted line identified as 79, formed in the casing structure.

Figure 4:
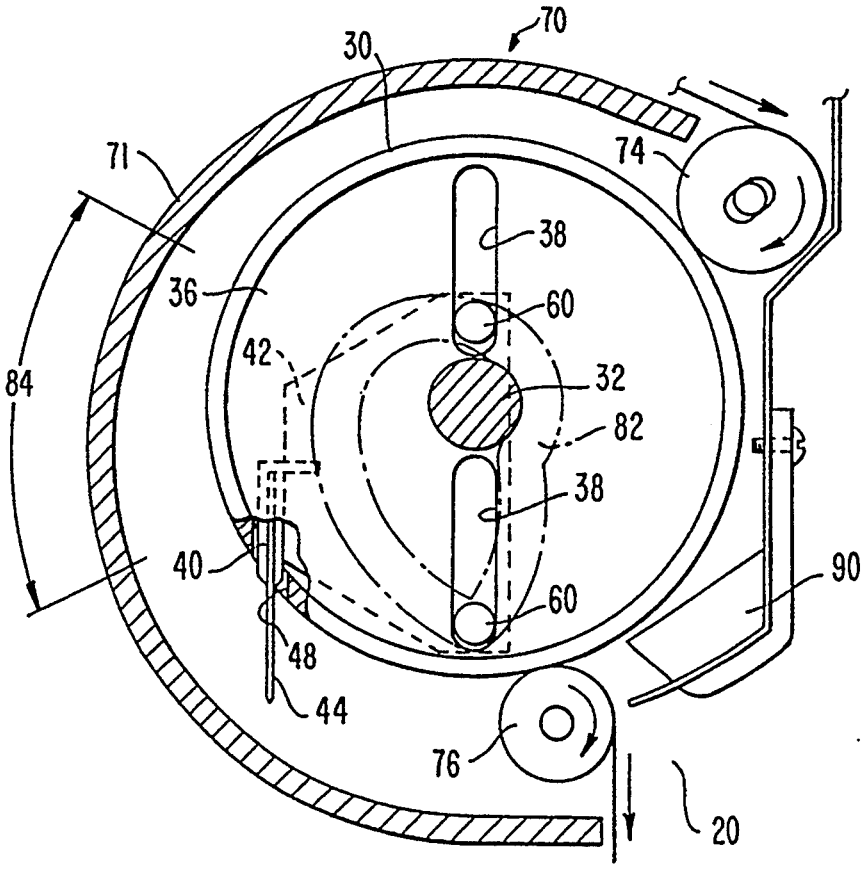
FIG. 4 is a view similar to FIG. 2 showing the feed roller and cutter apparatus in a different operating condition.

The path along which the web W of flexible sheet material moves from supply roll R through the dispensing and cutting mechanism will now be described. After leaving roll R, the web W is guided by the external surface of the housing 71, as seen in FIGS. 1, 2 and 4, to pass initially clockwise around the pinch roll 74. Web W then proceeds counterclockwise around the exterior of feed roll 30 which is provided with a high friction surface, formed, for example, of a resilient material. The housing 71, in generally concentrically enclosing feed roll 30, thereby assists in threading the leading end of the web W around the rear side of the feed roll within the dispenser chassis 10. Thereafter, the web W passes clockwise over the exit pinch roll 76 and exits through the discharge opening 20 placing its leading end WE in a position to be readily accessible externally of the dispenser chassis 10 for an intending user of the toweling material.

In order to remove web material from the dispenser it will be appreciated that a user will grasp the leading end WE of the web W and, in pulling it, cause the teed roll 30 to rotate thereby conducting the web along its intended path through the apparatus. The presence of the pinch rolls 74 and 76 biased against the teed roll 30 are effective to substantially isolate the longitudinally applied tensile stresses induced in the web W when it is pulled by the user to generate rotation of the feed roll. When the web W is pulled, the tension stresses in the web are, instead, substantially limited to that portion of the web which, at the upstream end, extends between the supply roll R and the lead-in pinch roll 74 and at the downstream end, extends between the pinch roll 76 and the grasp of the user. As a result, that length of web W which traverses the surface of feed roll 30 is, except for tensile stresses induced by the knife 40, relatively unstressed in the longitudinal direction when the free end WE of the web is pulled by the user.

Positive reciprocation of the cutting blade 40, and thereby projection of the cutting teeth 44 beyond the periphery of the feed roll 30 to cut the web and thereafter to retract the knife as the feed roll rotates, is effected by stationary cams that are mounted on opposite ends of the dispenser chassis 10 adjacent the respective ends of the feed roll. Each stationary cam in the illustrated embodiment is defined by a cam plate 80 having a cam track 82 formed therein. As shown in FIG. 3, each earn plate 80 is disposed within the housing 70 in abutment with the end plate 72. The earn followers 62 disposed in alignment with the guide pins 60 at the respective upper ends of the carrier plate 42 for the cutting knife 40 engage the respective cam tracks 82 of the cam plates 80. The particular configuration of the cam track 82, which is effective to drive the cutting knife in the desired manner, is shown by the broken lines in FIGS. 2 and 4. A web cutting apparatus, suitable for use in the described dispenser, is disclosed in detail in U.S. Pat. No. 4,712,461, issued Dec. 15, 1987 to Holger Rasmussen and assigned to the assignee hereof.

Support is provided for the feed roll 30 within the casing defined by housing 70 and end plates 72 by a sleeve bearing 84 disposed in each cam plate 80 within which the respective stub shafts 32 are journaled. The support structure for one end of the feed roll is shown in FIG. 3. A similar construction is provided at the opposite end of the casing for support of the other end of feed roll 30.

As shown in FIGS. 1, 2 and 4, a stripper bar 90 is fixed to the dispenser front wall 22. The lower or free end of the stripper bar 90, which is substantially coextensive with the feed roll 30, is disposed closely adjacent the surface of the feed roll immediately forwardly adjacent the exit pinch roll 76. The stripper bar 90 is operative to ensure that the web of creped material does not adhere to the high friction surface of the feed roll 30 following its emergence from the nip between the feed roll and exit punch roll but will, instead, be properly guided by the exit pinch roll 76 to the dispenser exit 20.

With web W threaded about the elements of the dispensing and cutting mechanism, as previously described, the cutting edge formed by teeth 44 on cutting blade 40 is initially disposed in its retracted position to lie within the periphery of feed roll 30. Due to the cam followers 62 engagement in the portion of the respective cam tracks 82, which are closely adjacent the axis of feed roll 30 defined by the supporting stub shafts 32, the application of a pulling force on the web end WE causes web material withdrawn from supply roll R to pass around lead-in pinch roll 74, thence around the high friction surface of feed roll 30 and, finally, around the exit pinch roll 76 for ultimate discharge through opening 20.

As the web material is pulled from the dispenser by the user, the web material frictionally engages the feed roll 30 causing it to rotate and the cam followers 62 to thus move counterclockwise, as shown in FIGS. 2 to 4, around the path of cam tracks 82. Continued rotational movement of the feed roll 30 moves the cam followers 62 from the uppermost position in cam tracks 82, as shown in FIGS. 1 and 2, to the lowermost position within cam tracks 82 shown in FIG. 4. During this one hundred and eighty degree rotation of feed roll 30, the teeth 44 on knife 40 progress from within the interior of the feed roll to a position where the cutting edge defined by the teeth is fully projected, as shown in FIG. 4. Also, during this rotation of the feed roll 30, while the cutting edges of teeth 44 project through the aligned slots 48 in the feed roll surface, the web W is cut in a way that results in its not being completely severed but, instead, small uncut portions defined by the recesses 46 in knife 40 remain along the line of cut. The approximate range of rotation of the feed roll 30 within which paper cutting occurs is designated by area 84 in FIG. 4.

Continued withdrawal of the web W by the user continues the rotation of the feed roll 30 thereby causing the cam followers 62 to move up within the cam tracks 82 of cam plates 80 to rapidly retract the cutting edges of teeth 44 on cutting blade 40 back within the feed roll. When the slots 48 on the feed roll surface reach the nip of the feed roll and exit pinch roller 76, the teeth 44 of knife 40 are fully retracted back within the feed roll. The knife 40 retains this fully retracted position as the cam followers 62 travel along the remaining path of cam tracks 82 and until the slots 48 reach the nip between feed roller 30 and pinch roller 74, the position of the knife 40 shown in FIG. 2.

According to the present invention, the operation of the described dispenser 10 is materially affected by the feed roll drive apparatus, indicated generally in FIG. 1 of the drawing by numeral 100. The feed roll drive 100 comprises a crank arm 102 fixedly secured to the feed roll 30 and a drive spring 104 attached, as at 106, to the crank arm to establish an eccentric connection with the feed roll. At its other end the spring 104 is fixed with respect to the chassis housing, here shown by being attached to a bracket 108 formed on the back plate 12.

The drive apparatus is particularly designed to effect loading of the spring 104 during the initial portion of the operating cycle of the dispenser when the user pulls the free end WE of web W to cause the feed roll 30 to rotate. The crank arm 102 and spring 104 are so organized with respect to the cutter assembly, that the spring becomes fully loaded at, or just prior to, that point in the operating cycle of the dispenser at which the knife 40 is fully extended and, consequently, has completed its cutting of the web W. Thus, when the feed roll 30 is moved beyond this point, the spring unloads and, in unloading, is caused to drive the feed roll and conduct the, now partially severed, web material carried thereby outside the dispenser. The relationship between the crank arm 102 and spring 104 is such that, when the energy stored in the spring is exhausted, the position of the crank arm and thereby the feed roll 30 will place the line of cut in the web W at a desired predetermined position beyond the opening 20 to make the free end WE of the succeeding length of material readily accessible to the grasp of a subsequent user of the dispenser. In this regard, therefore, the spring 104 is caused to act as a brake upon the rotating feed roll 30 causing it to stop at the desired predetermined position.

In imparting the resistive force on the feed roll 30 to effect braking, the spring 104 operates by producing a gradually increasing tensile force on the residual segments defined by the uncut web portions, which force is directed oppositely to the force applied by the grasp of the user and increases gradually to a level capable of exceeding the strength of the web segments whereupon the segments are caused to break. Upon completion of this action, the now completely severed sheet of web material is retained by the user and the free end WE of the succeeding length of web material returns to the desired position for grasping by a subsequent user.

A spring selected for use as a drive spring 104 in the described dispenser organization will include among its characteristics the capability of being extendable to the dead center position of the crank 102 by the user's pulling the web W to rotate the feed roll 30 and thus the crank 102 against the force of the spring. Thus, the spring must not be so strong as to cause an uncut web to tear when pulled to load the spring. On the other hand, the spring will contain sufficient stored energy when in its fully-extended condition and with the crank in its dead center position to drivingly rotate the feed roll 30 for conducting the web carried thereby out of the discharge opening 20. Moreover, with the spring in its exhausted condition the line of cut, prior to severance of the sheet, or the web end WE, after severance, will be disposed in the position to permit ready grasping of the web end by a subsequent user. Lastly, the selected spring will be possessed of sufficient strength that, prior to achieving its fully extended condition, will exert a force sufficient to exceed the strength of the residual uncut web segments such that the segments will break when a pull tending to load the spring is imposed on the web, such breaking force being achieved before the feed roll 30 and crank 102 are rotated to the dead center condition of the latter.

It will be appreciated that the force of spring 104 in the described organization can be employed to break the uncut web segments in two alternative modes of operation of the dispenser thereby insuring separation of the sheet. In the first, which is characterized essentially by the user's pulling the web end WE with only sufficient force to rotate the feed roll 30 adequately to actuate the knife 40 and to fully load the spring 104 by placing the crank arm 102 just beyond its "dead center" position, the feed roll 30, under the impetus of the stored energy in the spring, carries the web material and, particularly, the line of cut containing the residual web segments to the predetermined position outside the discharge opening. Due to the expenditure of energy in the spring 104, the feed roll 30 comes to rest at a position which places the line of cut in the web at its predetermined location. Thus, the user simply grasps the web below the line of cut and applies a pulling force thereto. This serves to apply a force on the feed roll 30 and, thus, on the spring 104 tending to again load it. However, the strength of the web segments being insufficient to permit the spring to be fully loaded, when the resultant of the pulling force by the user and the loading force on the spring exceeds the strength of the uncut web segments, the segments are caused to break thereby placing the now completely severed sheet in the hands of the user and causing the feed roll 30 to move backwardly to place the free end WE of the succeeding length of web W at the predetermined position for grasping by a subsequent user.

According to an alternate mode of operation, which may be characterized by the user's applying an excessive initial pulling force on the web, or by the use of a heavier than required spring, the uncut web segments on the line of cut may be broken by the initial effect of the feed roll 30 in rotating beyond the point of relaxation of the spring 30 and into the loading region of the next operating cycle. Under these conditions, with the user not applying a pulling force, but simply holding the web below the line of cut, the resultant force can be sufficient to break the segments.

It will be appreciated that, under the latter-described mode of operation, since the initial force of the feed roll 30 is significantly less than that required to move the crank arm 102 to its "dead center" position, upon severance of the web segments the spring force on the 104 will be expended to return it to its relaxed position. Concomitantly, the feed roll 30 and the free end WE of web material W carried thereby undergo retrograde movement to return the free end WE of the web W to its predetermined position and leaving the now-severed sheet in the hands of the user.

It will also be appreciated that these described modes of operation of the invention are augmented by the presence of the exit pinch roll 76 to the extent of insuring that insufficient tensile forces are imposed on the residual, unsevered segments in the web until the line of cut that contains them extends beyond the nip or point of engagement between the exit pinch roll 76 and the feed roll 30. Thus, due to the presence of the exit pinch roll 76, particularly as it cooperates with the entry pinch roll 74, a region of reduced tensile stress in the web W that surrounds the feed roll 30 is created between the entry and exit pinch rolls 74 and 76 respectively. Consequently, after the web W is cut by knife 40 to place it in its weakened condition with its continuity being maintained only by the residual web segments, even if a pulling of the web by a user is not adequately compensated by movement of the feed roll 30 under the impetus of the unloading of the stored spring energy, the pressure applied by the exit pinch roll 76 forcing the web material against the surface of the feed roll restricts the amount of tensile stress that can be effectively imparted to the uncut web segments when they have not yet moved beyond the nip of the exit pinch roll so as to protect against the segments being broken before the line of cut in the web emerges from the discharge opening 20.

Figure 7:
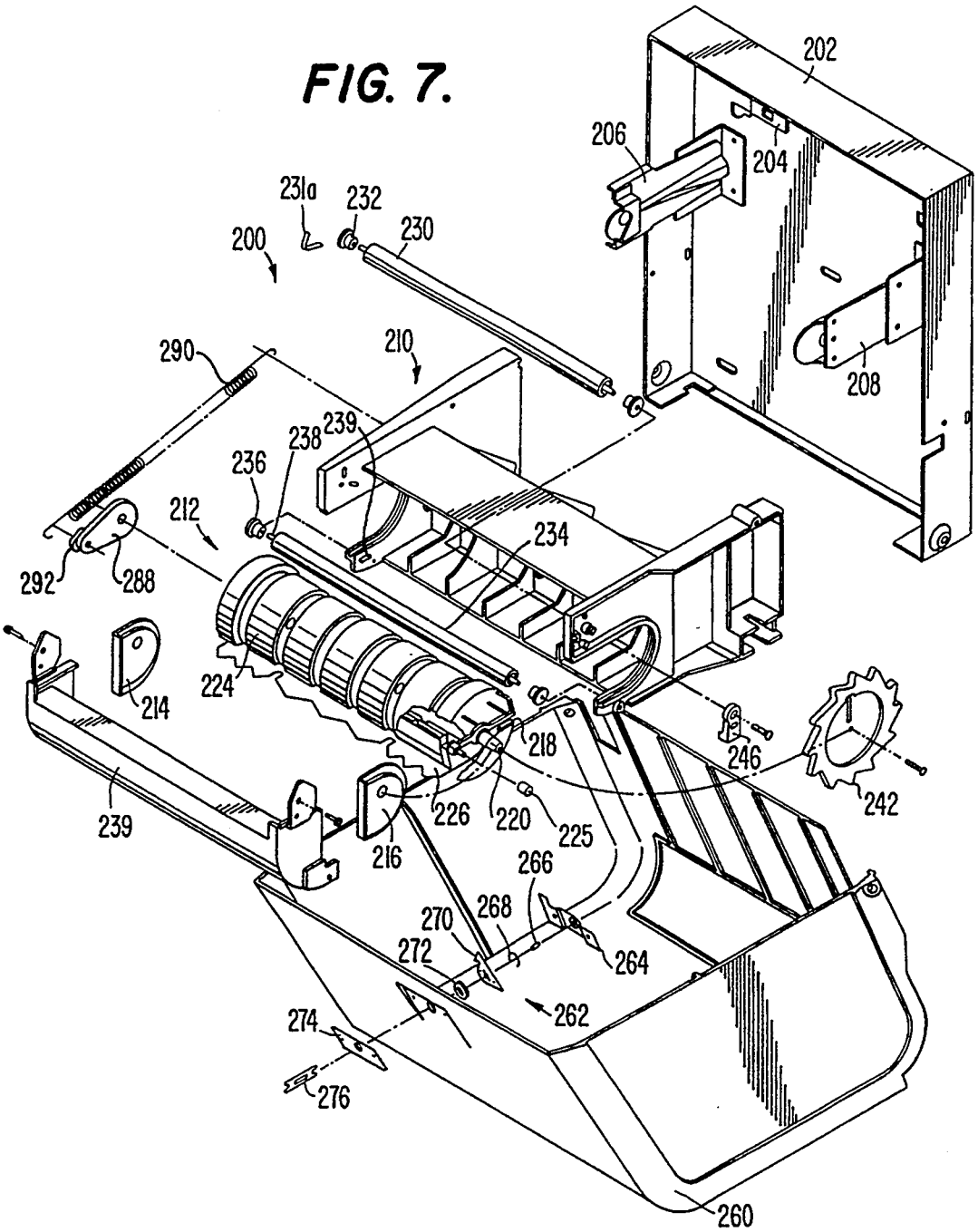
FIG. 7 is an exploded perspective view of a dispenser according to the invention suitable for commercial utility.
Figure 8:
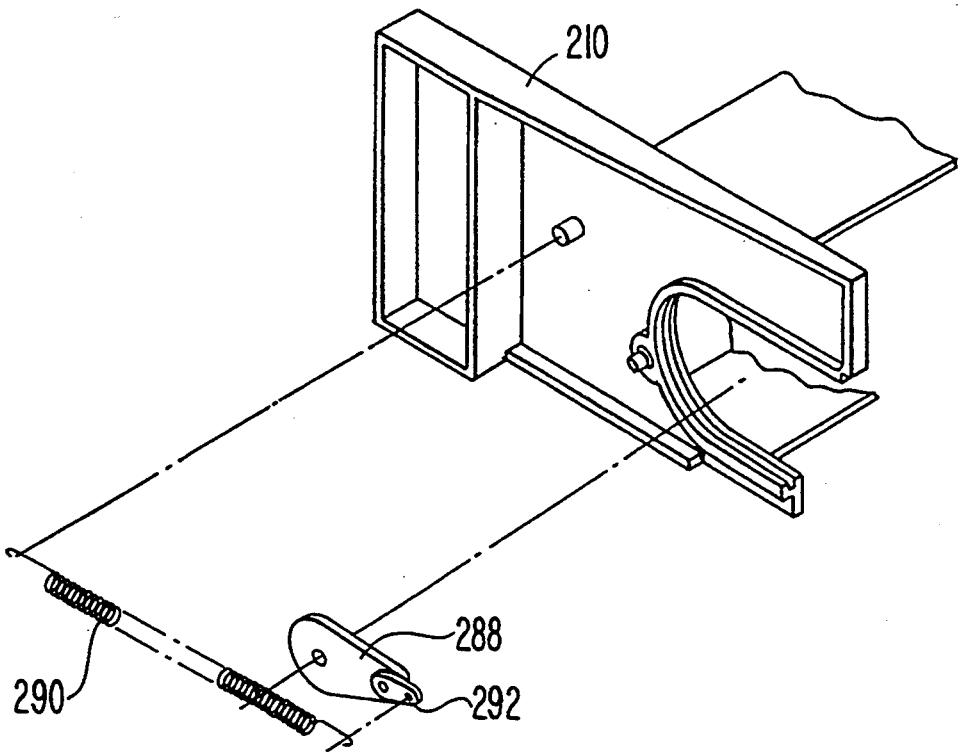
FIG. 8 is an exploded perspective view of a principal part of the end portion of the apparatus shown in FIG. 7.

FIG. 7 is a showing of the construction of a substantial commercial embodiment of the rolled material dispenser according to the invention. The dispenser, indicated generally by reference numeral 200, includes a back plate 202 mountable against a wall or other support surface so that the paper toweling, or other webbed material therein, can be conveniently dispensed by intending users. A strike plate 204 depends downwardly from the front of the top lip of the back plate 202. Welded or riveted roll mount assemblies 206, 208 are attached to the back plate 202 at upper inside locations to provide the rotatable support for the roll of web material (not shown). A housing, shown generally at 210, whose improved design provides greater stiffness and dimensional stability during the molding thereof, is secured to the back plate 202 at a lower location thereof. The feed roll shown generally at 212, is rotatably secured to, and mounted in, the housing 210 by left and right earn chocks 214, 216. A front corner portion of the feed roll 212 is broken away to illustrate internal components thereof. The feed roll 212 includes a bottom roll 218, a top roll 220, high-friction tires 224, a pair of earn follower rollers 225, and a knife 226. The knife 226 is movable with respect to the tires 224 in a controlled cutting motion to produce a line of cut in the web containing the earlier described uncut web segments.

The feed roll 212 has a crank 288 fixed thereto, that corresponds in operation to the earlier-described crank 102, activated under the impetus of spring 290. In the commercial embodiment of the invention it is desirable to connect the spring 290 to the crank 288 by way of an intermediate articulated link 292 thereby to eliminate undue wear at the connection between the spring and the crank.

Figure 9:
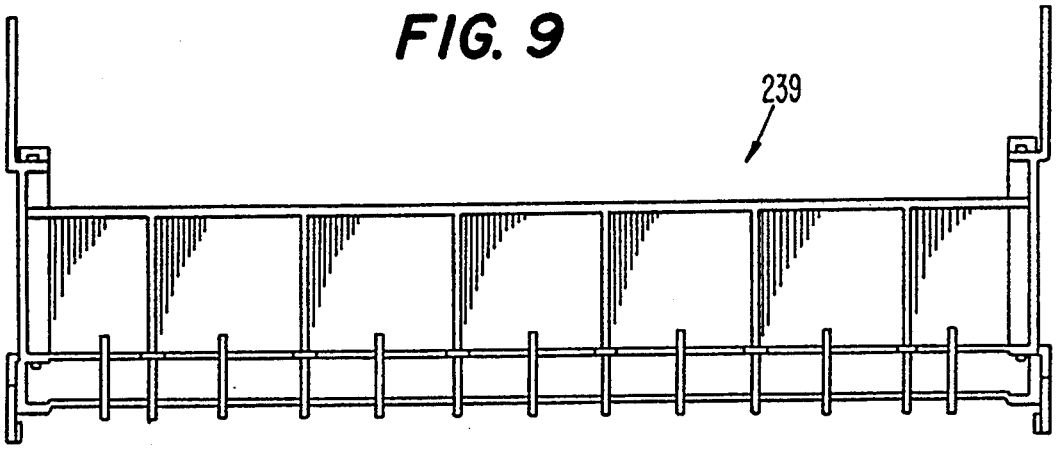
FIG. 9 is a rear elevational view of the stripper bar of the dispenser shown in FIG. 7.
Figure 10:
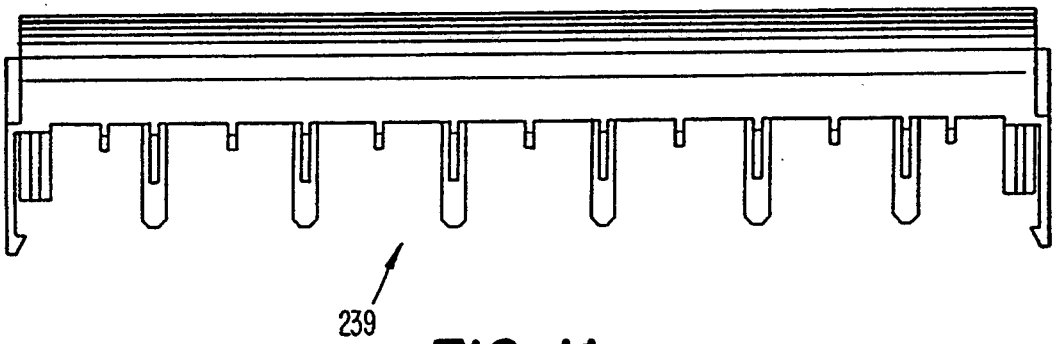
FIG. 10 is a bottom plan view of the stripper bar of FIG. 9.
Figure 11:
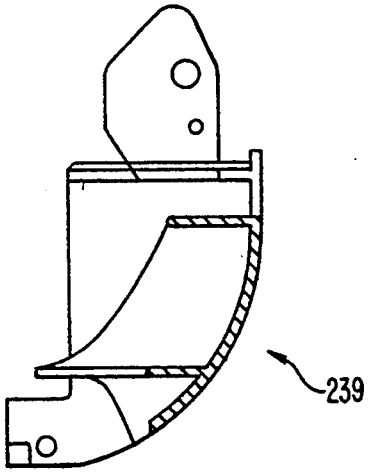
FIG. 11 is a side sectional view of the stripper bar of FIG. 9.

An upper pinch roll 230, biased by springs 231, is attached via pinch roll bushings 232 and the web windingly passes the upper pinch roll, the feed roll 212, and then the lower or exit pinch roll 234, that effectively grips the web material thereby eliminating premature breaking of the uncut portions of the toweling material. The exit pinch roll 234 is secured by bushings 236 attached to the pinch roll shaft 238. However, while the upper pinch roll 230 is spring-biased against the feed roll 212, the organization of the exit pinch roll 234, and particularly of its journal mounts, is such as to insure that the exit pinch roll is biased against the feed roll only when the web W is grasped by the user and a tensile strain is imposed on the web. Thus, the journal openings for the axles of the exit pinch roll 234 are formed in the casing as slots 239 which are elongated in a direction that permits the biasing effect of the pinch roll against the feed roll surface to be imparted by the pull on the web imposed by the user and not by springs. The web withdrawn from a roll secured to the mount assemblies 206, 208 is, therefore, threaded counterclockwise around an upper pinch roll 230 (which is biased by springs 231), clockwise around the rear side of the feed roll 212, and counterclockwise over the exit pinch roll 234 for delivery from the dispenser. Augmenting this operation is a stripper bar 239 that is secured to the housing 210 generally in front of the feed roll 212. The stripper bar 239 is illustrated in greater detail and in isolation in FIGS. 9 to 11.

A feed wheel 242 is shown in FIG. 7 for attachment to the axle 220 of feed roll 212. The wheel 242, by means of the teeth circumferentially spaced around its periphery, enable the feed roll 212 to be manually rotated to assist in initially feeding the leading end of web material from a roll through the dispenser mechanism. As shown, the teeth on the feed wheel can be formed in ratchet-like fashion to cooperate with a pawl 246 for preventing undue retrograde rotation of the feed roll following the dispensing of a sheet.

In the practice of the described invention, however, it may be desirable to eliminate the pawl 246 from coaction with the feed wheel teeth since such anti-reversing mechanism may not be required, and may even be undesirable. Use of a pawl may not be required due to the fact that, as previously described, relaxation of the spring 290 following separation of the uncut web segments is effective to return the feed roll 212 and the free end WE of web W carried thereby to the desired predetermined position whereby the dispensing of an excessive length of web material is avoided.

Use of an anti-reversing mechanism may be undesirable, on the other hand, due to the fact that its operation, in preventing any retrograde movement of the feed roll 212 and thus relaxation of the spring 290 in situations where, for example, the spring has been caused to incur some reloading because of an inertial force imposed on the feed roll. Thus, presence of the anti-reversing mechanism in this situation has the undesirable effect of potentially maintaining a loading strain on the spring during extended periods of non-use of the mechanism.

The operation of this commercial embodiment of the invention corresponds in all material respects to the operation of the earlier described illustrative embodiment. Thus, with the roll of web material inserted and held in the roll mount assemblies 206, 208 and the material would around the upper and lower pinch rolls 230, 234 and the feed roll 212, the cover 260, which is pivoted at the bottom to the back plate 202, is pivoted upwardly to snap into place, protecting the internal components of the dispenser. The locking assembly for locking the cover 260 in its closed position relative to the back plate 202 is shown generally at 262, and includes a plate lock 264, a stud lock 266, a spring lock 268, a hammer lock 270, a lock barrel 272, a lock plate 274, and a key 276.

Thereafter, as the user pulls the web material from the dispenser, the feed roll 212 is rotatably driven, due to the frictional engagement between the web and the tires 224 which surround the feed roll surface. In rotating, the feed roll 212 drives the cutting blade 226 to produce a line of cut in the web containing small, uncut residual segments that maintain the continuity of the web. Simultaneously with driving the cutter, the feed roll 212, through the action of the crank 288, loads the spring 290 by extending it to thereby store energy within it.

Desirably, the dead center position of the crank 288 occurs when the cutting blade 226 is at, or just prior to, its fully extended position from the feed roll 212 indicating a substantial completion of the web-cutting operation. Upon further rotation of the feed roll the energy stored in spring 290 is unloaded whereupon the feed roll is now driven by the crank to deliver the web material through the discharge opening from the dispenser. When the energy in the spring 290 is expended the feed roll provides a resistive force against which the user may pull the web to sever the uncut segments. Alternatively, when there is sufficient inertia in the feed roll 212, the user may simply hold the web material whereupon the uncut segments are broken as feed roll rotates beyond the position at which the spring energy is exhausted.

In both of the previously described situations, it will be appreciated that rotation of the feed roll will be arrested by the spring force thus to dispose the leading end WE of the succeeding length of web material at the position at which it can be readily grasped by a subsequent user of the apparatus. While in the former mode of operation the feed roll may be essentially at rest when the uncut web segments are severed by the pull exerted by the user. In the latter mode of operation, on the other hand, since the force of the spring is selected such that in its fully extended condition it is greater than the strength of the residual uncut web segments, the segments will break before the feed roll achieves the next dead center position of the crank. Thus, upon severance of the segments the feed roll through the exertion of the spring will be returned to the desired position at which the leading end of the succeeding length of web material can be conveniently grasped by a subsequent user.

It will be appreciated that, in utilizing the drive spring to arrest movement of the feed roll thereby to provide the resistive force against which the residual web segments are broken, a smooth, complete severence of the material is obtained. Not only does severing the tabs in this manner insure that only one sheet of material is dispensed at a time, it also promotes trouble-free operation of a dispenser that is leas costly to manufacture and that occupies less space at its point of use.

From the foregoing detailed description, it will be evident that changes, adaptations and modifications of the present invention can be made by those persons having ordinary skill in the art to which the aforementioned invention pertains. However, it is intended that all such variations not departing from the spirit of the invention, as recited in the claims, be considered as being within the scope thereof as limited solely by the appended claims.

We claim:

1. A method of dispensing a web of flexible sheet material without need of a positive stop mechanism from a dispenser having a discharge opening and containing a feed roll traversed by said web, knife means for perforating the web as the web traverses the feed roll, and an energy storing spring operatively connected to said feed roll, comprising the steps of:

pulling the web to impart rotation to said feed roll and to load said spring over one portion of the rotational cycle of said feed roll;

actuating said knife means for perforating said web to produce a line of cut therein containing a plurality of residual unsevered segments;

driving said feed roll by the energy stored in said spring over another portion of the rotational cycle of said feed roll to deliver the portion of said web containing said line of cut to a predetermined position accessible to a user; and thereafter, severing said web along said line of cut by causing said feed roll to rotate beyond a position corresponding to said predetermined position of said web portion containing said line of cut in which said spring is again loaded to generate against the pull of the user tensile stresses in said residual segments that increase gradually until said segments break.

2. The method of claim 1 in which said severing step is effected by pulling the web to reload said spring following said perforating step.

3. The method of claim 2 including the step of bringing said feed roll to rest with said perforated web at said predetermined position prior to said severing step.

4. The method according to claim 1 in which said step of perforating said web occurs prior to said feed roll driving step.

5. The method according to claim 4 including the step of relaxing the load on said spring following severance of said web to return the end of the remainder of said web to said predetermined position.

6. The method according to claim 5 including the step intermediate said perforating and said severing steps of restricting the tensile strain imparted to said unsevered web portion.

7. The method according to claim 6 in which said tensile strain restricting step is effected by biasing said web against said feed roll.

8. The method according to claim 7 in which said dispenser includes a pinch roll in operative position with respect to said feed roll for isolating the partially severed web from the tensile force generated by pulling said web, and said web-biasing step is performed by manually urging said pinch roll toward said feed roll.

9. A dispenser operable to dispense sheets separated from perforated flexible web material without the presence of a dedicated stop mechanism, comprising:

a chassis forming a housing having a material discharge opening;

means carried by said chassis for feeding a continuous web of flexible sheet material;

means for perforating said web to produce therein a transverse line of cut containing residual unsevered segments of web material for maintaining the continuity of said web;

a feed roll mounted on said chassis for rotation through an operating cycle in which said web is conducted from said feed means into operative relation to said perforating means and thence to a predetermined position with respect to said discharge opening to be grasped by a user for pulling said web from said dispenser and thereby impart rotational movement to said feed roll; and a spring operatively connected to said feed roll forming an energy storing means that is loaded during rotation of said feed roll through an initial portion of said operating cycle, unloaded during another portion of said operating cycle in which said feed roll is rotated to conduct said sheet material web with the line of cut thereon to a position accessible by said user, and reloaded by further rotation of said feed roll, whereby said spring upon reloading, is operative to independently generate against the pull of said user a resistive force sufficient to impart tensile stresses in said residual segments that increase gradually until said segments break.

10. A dispenser according to claim 8 in which said spring is connected to said feed roll as, when relaxed, to dispose said line of cut in said predetermined position outside said discharge opening.

11. A dispenser according to claim 9 in which said spring is connected to said feed roll to impart said resistive force to said feed roll subsequent to achieving its unloaded, relaxed condition in the operating cycle of said feed roll.

12. A dispenser according to any one of claims 9 or 10 in which said feed roll includes an eccentric crank drivingly connected thereto and said spring having one end connected to said crank and the other end fixedly secured with respect to said chassis.

13. A dispenser according to any one of claims 1, 3 or 4 including a pinch roll cooperating with said feed roll downstream, in the material-moving sense, from the point of engagement of said perforating means with said web and operative to bias said material against said feed roll for isolating said cut web from a tensile force applied to said web by said user, and means for biasing said pinch roll toward said feed roll.

14. A dispenser according to claim 13 in which said pinch roll is operably positioned between the surface of said feed roll and said discharge opening.

15. A dispenser according to claim 13 in which said pinch roll biasing means comprises journal means mounting said pinch roll for rotation, and means for moving said pinch roll in said journal means toward said feed roll under the urging of the grasp of said user in pulling said web from said dispenser.

16. A dispenser according to claim 15 in which said journal means comprises opposed elongated slots in said chassis for reception of the ends of said pinch roll, said slots being disposed forwardly of said feed roll and each having a generally horizontal longitudinal axis extending toward said feed roll.

17. A dispenser operable to dispense sheets separated from perforated flexible web material without the presence of a dedicated stop mechanism, comprising:

a chassis forming a housing having a material discharge opening;

means on said chassis for supplying a continuous web of flexible sheet material;

a cutter for perforating said web to produce therein a transverse line of cut containing residual unsevered segments of web material for maintaining the continuity of said web;

a feed roll mounted on said chassis for rotation through an operating cycle in which said web is conducted from said supply means into operative relation to said cutter and thence to a predetermined position exteriorly of said discharge opening to be grasped by a user for pulling said web from said dispenser and thereby impart rotational movement to said feed roll; and a spring operatively connected to said feed roll forming an energy storing means that is loaded during rotation of said feed roll through an initial portion of said operating cycle, unloaded during a succeeding portion of said operating cycle in which said feed roll is rotated to conduct said sheet material web with the line of cut thereon to a position accessible by said user exteriorly of said discharge opening, and reloaded upon further rotation of said feed roll, whereby said spring, upon reloading, operates to generate in said feed roll a resistive force acting on said web against the pull of said user to impart tensile stresses in said residual segments that increase gradually until said segments break.

18. A dispenser according to claim 17 in which said feed roll has a generally cylindrical surface about its axis of rotation, and the surface of said web material traversing said cylindrical surface along a substantial portion of the length thereof.

19. A dispenser according to claim 18 in which said cutter is operably mounted within the interior of said feed roll, and a cutter operator effective to extend said cutter substantially radially through said cylindrical surface of said feed roll for penetrating the engaged portion of said web material.

20. A dispenser according to claim 19 including pinch roll means for biasing said web material to said feed roll surface on opposite sides of said cutter-operator on said feed roll, whereby said cut web is isolated from tensile forces applied to said web remote from said cutter.

21. A dispenser according to claim 20 in which said pinch roll means includes an exit pinch roll located downstream, in the material-moving sense, from the point of engagement of said cutter with said web and operative to bias said material against said feed roll for isolating said cut web from a tensile force applied to said web by said user, and means for biasing said pinch roll against said feed roll.

* * * * *

UNITED STATES PATENT AND TRADEMARK OFFICE

CERTIFICATE OF CORRECTION

PATENT NO. : 5,441,189

DATED : August 15, 1995

INVENTOR(S) : John S. Formon and Paul W. Jespersen

It is certified that error appears in the above-identified patent and that said Letters Patent is hereby corrected as shown below:

Column 1, line 47, "acrid/ate" should read --activate--;
Column 6, lines 45 & 48, "teed" should read --feed--;
Column 7, line 4, "earn" should read --cam--;
Column 10, lines 45 & 49, "earn" should read --cam--;
Column 12, line 55, "leas" should read --less--;
Column 14, line 16, "8" should read --9--;
Column 14, line 20, "9" should read --10--;
Column 14, line 25, "9 or 10" should read --10 or 11-- and
Column 14, lines 30 & 31, "1, 3 or 4" should read --9, 10 or 11--.

Signed and Sealed this

Tenth Day of October, 1995

*Attest:*

Bruce Lehman

BRUCE LEHMAN

*Attesting Officer*

*Commissioner of Patents and Trademarks*